United States Patent [19]

Meskin et al.

[11] Patent Number: 4,529,047

[45] Date of Patent: Jul. 16, 1985

[54] CUTTING TOOTH AND A ROTATING BIT HAVING A FULLY EXPOSED POLYCRYSTALLINE DIAMOND ELEMENT

[75] Inventors: Alexander K. Meskin, Salt Lake City; Clifford R. Pay, Woods Cross, both of Utah

[73] Assignee: Norton Christensen, Inc., Salt Lake City, Utah

[21] Appl. No.: 469,209

[22] Filed: Feb. 24, 1983

[51] Int. Cl.[3] ..... E21B 10/46

[52] U.S. Cl. ..... 175/329; 175/410

[58] Field of Search ..... 175/329, 330, 409, 410

[56] References Cited

U.S. PATENT DOCUMENTS

| | | | |
|---|---|---|---|
| 2,818,233 | 12/1957 | Williams, Jr. | 175/330 |
| 3,747,699 | 7/1973 | Feenstra | 175/329 |
| 4,190,126 | 2/1980 | Kabashima | 175/410 |

OTHER PUBLICATIONS

GE (SMD 19-413), Geo Set, Sep. 1981.

GE (SMD 18-404), Geo Set, 10-18-82.

*Primary Examiner*—James A. Leppink

*Assistant Examiner*—Michael Goodwin

*Attorney, Agent, or Firm*—Beehler, Pavitt, Siegemund, Jagger & Martella

[57] ABSTRACT

The present invention is an improvement in the cutting tooth used in a rotating drilling bit wherein the cutting tooth incorporates a synthetic triangularly shaped prismatic diamond element. The polycrystalline diamond element is substantially exposed above the bit face of the bit and is supported and retained on the bit face by disposition within a tooth of matrix material integrally formed with the bit face. The tooth is particularly characterized by having a trailing support in the shape of a tapered teardrop with a leading face on the trailing support that is at least in part adjacent and contiguous to the trailing face of the diamond cutting element and is congruous at the plane of contact with the diamond cutting element and tapers thereafter to a point on the bit face to minimize the amount of matrix material in the tooth which must to be removed by wearing before a useful cutting surface of the polycrystalline diamond element can be exposed.

22 Claims, 10 Drawing Figures

Fig. 1
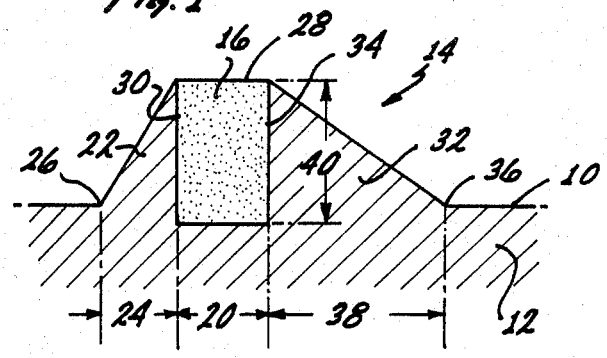
Fig. 2
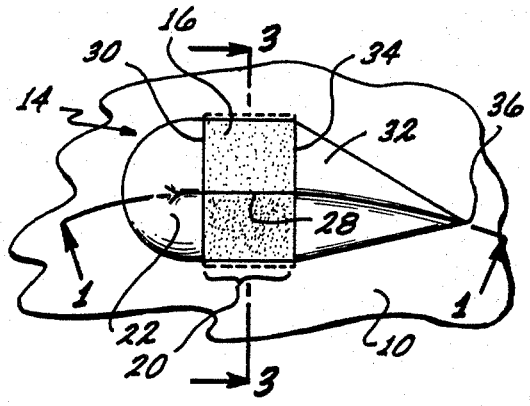
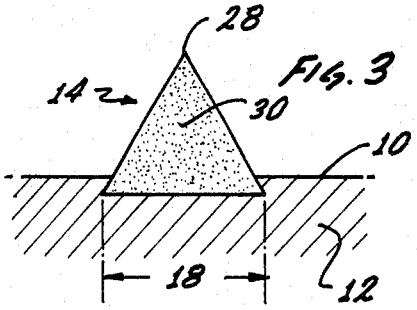
Fig. 3
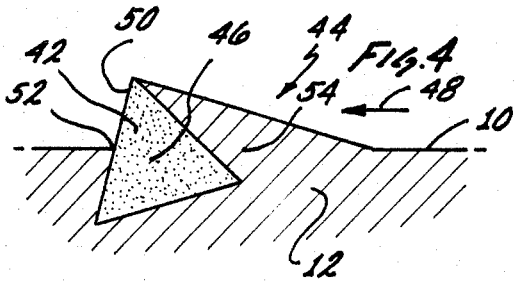
Fig. 4
Fig. 5
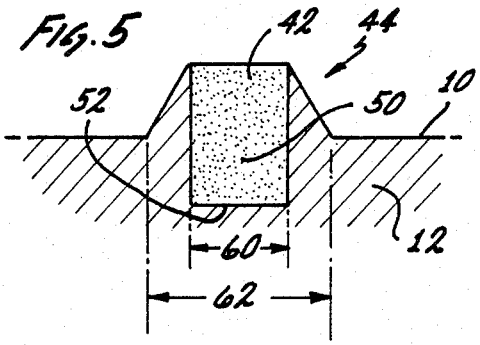
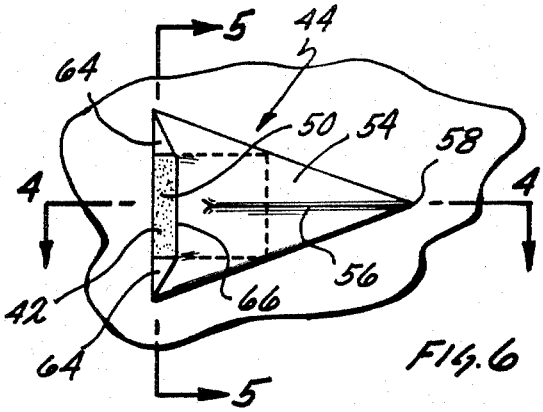
Fig. 6
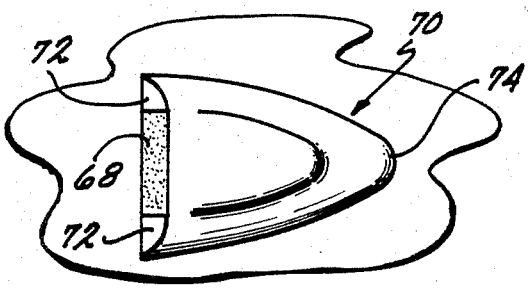
Fig. 7

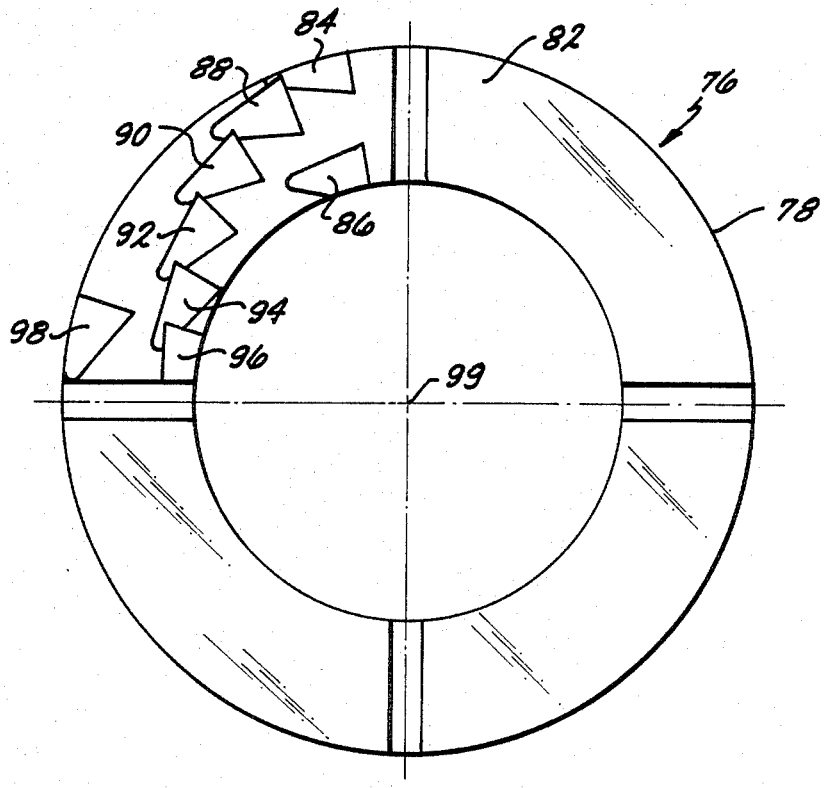
Fig. 8
Fig. 9
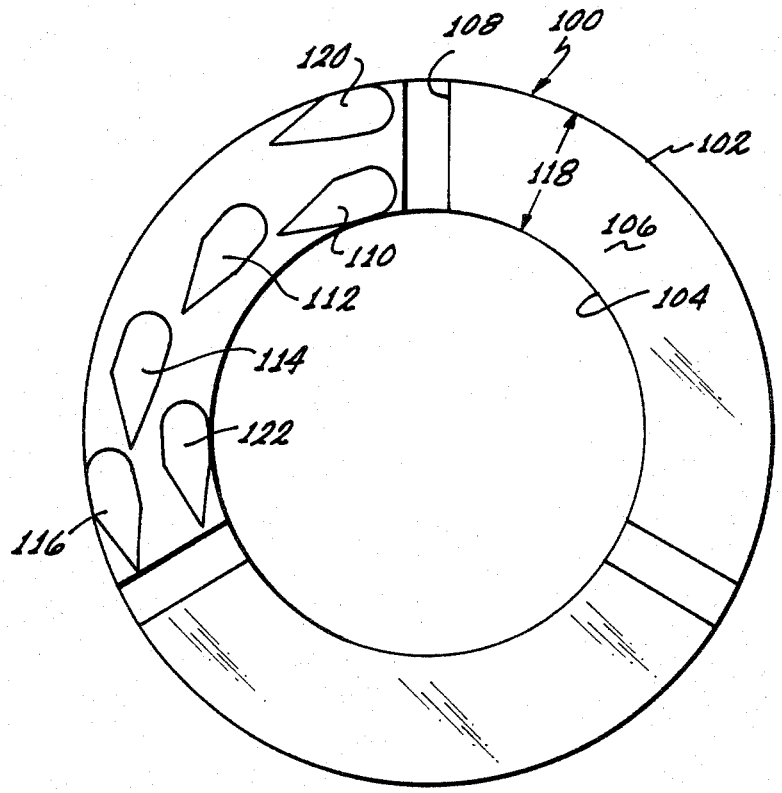

CUTTING TOOTH AND A ROTATING BIT HAVING A FULLY EXPOSED POLYCRYSTALLINE DIAMOND ELEMENT

FIELD OF THE INVENTION

The present invention relates to the field of earth boring bits and more particularly to such bits as embodied in rotary bits incorporating diamond cutting elements.

DESCRIPTION OF THE PRIOR ART

The use of diamonds in drilling products is well known. More recently synthetic diamonds both single crystal diamonds (SCD) and polycrystalline diamonds (PCD) have become commercially available from various sources and have been used in such products, with recognized advantages. For example, natural diamond bits effect drilling with a plowing action in comparison to crushing in the case of a roller cone bit, whereas synthetic diamonds tend to cut by a shearing action. In the case of rock formations, for example, it is believed that less energy is required to fail the rock in shear than in compression.

More recently, a variety of synthetic diamond products has become available commercially some of which are available as polycrystalline products. Crystalline diamonds preferentially fractures on (111), (110) and (100) planes whereas PCD tends to be isotropic and exhibits this same cleavage but on a microscale and therefore resists catastrophic large scale cleavage failure. The result is a retained sharpness which appears to resist polishing and aids in cutting. Such products are described, for example, in U.S. Pat. Nos. 3,913,280; 3,745,623; 3,816,085; 4,104,344 and 4,224,380.

In general, the PCD products are fabricated from synthetic and/or appropriately sized natural diamond crystals under heat and pressure and in the presence of a solvent/catalyst to form the polycrystalline structure. In one form of product, the polycrystalline structures includes sintering aid material distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being achieved by dissolving out the nondiamond material or at least a portion thereof, as disclosed for example, in U.S. Pat. Nos. 3,745,623; 4,104,344 and 4,224,380. For convenience, such a material may be described as a porous PCD, as referenced in U.S. Pat. No. 4,224,380.

Polycrystalline diamonds have been used in drilling products either as individual compact elements or as relatively thin PCD tables supported on a cemented tungsten carbide (WC) support backings. In one form, the PCD compact is supported on a cylindrical slug about 13.3 mm in diameter and about 3 mm long, with a PCD table of about 0.5 to 0.6 mm in cross section on the face of the cutter. In another version, a stud cutter, the PCD table also is supported by a cylindrical substrate of tungsten carbide of about 3 mm by 13.3 mm in diameter by 26 mm in overall length. These cylindrical PCD table faced cutters have been used in drilling products intended to be used in soft to medium-hard formations.

Individual PCD elements of various geometrical shapes have been used as substitutes for natural diamonds in certain applications on drilling products. However, certain problems arose with PCD elements used as individual pieces of a given carat size or weight. In general, natural diamond, available in a wide variety of shapes and grades, was placed in predefined locations in a mold, and production of the tool was completed by various conventional techniques. The result is the formation of a metal carbide matrix which holds the diamond in place, this matrix sometimes being referred to as a crown, the latter attached to a steel blank by a metallurgical and mechanical bond formed during the process of forming the metal matrix. Natural diamond is sufficiently thermally stable to withstand the heating process in metal matrix formation.

In this procedure above described, the natural diamond could be either surface-set in a predetermined orientation, or impregnated, i.e., diamond is distributed throughout the matrix in grit or fine particle form.

With early PCD elements, problems arose in the production of drilling products because PCD elements especially PCD tables on carbide backing tended to be thermally unstable at the temperature used in the furnacing of the metal matrix bit crown, resulting in catastrophic failure of the PCD elements if the same procedures as were used with natural diamonds were used with them. It was believed that the catastrophic failure was due to thermal stress cracks from the expansion of residual metal or metal alloy used as the sintering aid in the formation of the PCD element.

Brazing techniques were used to fix the cylindrical PCD table faced cutter into the matrix using temperature unstable PCD products. Brazing materials and procedures were used to assure that temperatures were not reached which would cause catastrophic failure of the PCD element during the manufacture of the drilling tool. The result was that sometimes the PCD components separated from the metal marix, thus adversely affecting performance of the drilling tool.

With the advent of thermally stable PCD elements, typically porous PCD material, it was believed that such elements could be surface-set into the metal matrix much in the same fashion as natural diamonds, thus simplifying the manufacturing process of the drill tool, and providing better performance due to the fact that PCD elements were believed to have advantages of less tendency to polish, and lack of inherently weak cleavage planes as compared to natural diamond.

Significantly, the current literature relating to porous PCD compacts suggests that the element be surface-set. The porous PCD compacts, and those said to be temperature stable up to about 1200° C. are available in a variety of shapes, e.g., cylindrical and triangular. The triangular material typically is about 0.3 carats in weight, measures 4 mm on a side and is about 2.6 mm thick. It is suggested by the prior art that the triangular porous PCD compact be surface-set on the face with a minimal point exposure, i.e., less than 0.5 mm above the adjacent metal matrix face for rock drills. Larger one per carat synthetic triangular diamonds have also become available, measuring 6 mm on a side and 3.7 mm thick, but no recommendation has been made as to the degree of exposure for such a diamond. In the case of abrasive rock, it is suggested by the prior art that the triangular element be set completely below the metal matrix. For soft nonabrasive rock, it is suggested by the prior art that the triangular element be set in a radial orientation with the vase at about the level of the metal matrix. The degree of exposure recommended thus depended on the type of rock formation to be cut.

The difficulties with such placements are several. The difficulties may be understood by considering the dynamics of the drilling operation. In the usual drilling operation, be it mining, coring, or oil well drilling, a fluid such as water, air or drilling mud is pumped through the center of the tool, radially outwardly across the tool face, radially around the outer surface (gage) and then back up the bore. The drilling fluid clears the tool face of cuttings and to some extent cools the cutter face. Where there is insufficient clearance between the formation cut and the bit body, the cuttings may not be cleared from the face, especially where the formation is soft or brittle. Thus, if the clearance between the cutting surface-formation interface and the tool body face is relatively small and if no provision is made for chip clearance, there may be bit clearing problems.

Other factors to be considered are the weight on the drill bit, normally the weight of the drill string and principally the weight of the drill collar, and the effect of the fluid which tends to lift the bit off the bottom. It has been reported, for example, that the pressure beneath a diamond bit may be as much as 1000 psi greater than the pressure above the bit, resulting in a hydraulic lift, and in some cases the hydraulic lift force exceeds 50% of the applied load while drilling.

One surprising observation made in drill bits having surface-set thermally stable PCD elements is that even after suffient exposure of the cutting face has been achieved, by running the bit in the hole and after a fraction of the surface of the metal matrix was abraded away, the rate of penetration often decreases. Examination of the bit indicates unexpected polishing of the PCD elements. Usually ROP can be increased by adding weight to the drill string or replacing the bit. Adding weight to the drill string is generally objectionable because it increases stress and wear on the drill rig. Further, tripping or replacing the bit is expensive since the economics of drilling in normal cases are expressed in cost per foot of penetration. The cost calculation takes into account the bit cost plus the rig cost including trip time and drilling time divided by the footage drilled.

Clearly, it is desirable to provide a drilling tool having thermally stable PCD elements and which can be manufactured at reasonable costs and which will perform well in terms of length of bit life and rate of penetration.

It is also desirable to provide a drilling tool having thermally stable PCD elements so located and positioned in the face of the tool as to provide cutting without a long run-in period, and one which provides a sufficient clearance between the cutting elements and the formation for effective flow of drilling fluid and for clearance of cuttings.

Run-in in diamond bits is required to break off the tip or point of the triangular cutter before efficient cutting can begin. The amount of tip loss is approximately equal to the total exposure of natural diamonds. Therefore, an extremely large initial exposure is required for synthetic diamonds as compared to natural diamonds. Therefore, to accommodate expected wearing during drilling, to allow for tip removal during run-in, and to provide flow clearance necessary, substantial initial clearance is needed.

Still another advantage is the provision of a drilling tool in which thermally stable PCD elements of a defined predetermined geometry are so positioned and supported in a metal matrix as to be effectively locked into the matrix in order to provide reasonably long life of the tooling by preventing loss of PCD elements other than by normal wear.

It is also desirable to provide a drilling tool having thermally stable PCD elements so affixed in the tool that it is usable in specific formations without the necessity of significantly increased drill string weight, bit torque, or significant increases in drilling fluid flow or pressure, and which will drill at a higher ROP than conventional bits under the same drilling conditions.

BRIEF SUMMARY OF THE INVENTION

The present invention is an improvement in a rotating bit having a bit face and center including a plurality of polycrystalline diamond (PCD) elements disposed in a corresponding plurality of teeth wherein each tooth comprises a projection extending from the face of the bit including a trailing support integral with the matrix material of the bit face contiguous with at least the trailing face of the polycrystalline diamond element. The trailing support is particularly characterized as having a tapered longitudinal cross section substantially congruous with the polycrystalline diamond element at the plane of contiguous contact between the element and the trailing support and tapering therefrom to a point on the face of the bit to form a teardrop-shaped element.

These and other aspects in various embodiments of the present invention can better be understood by reviewing the following Figures in light of the following detailed description.

BRIEF DESCRIPTION OF THE DRAWINGS

FIG. 1 is a longitudinal cross section taken through line 1—1 of FIG. 2 showing a tooth in a bit devised according to the present invention.

FIG. 2 is a plan outline of the first embodiment of the tooth.

FIG. 3 is a perpendicular cross section taken through a line 3—3 of FIG. 2.

fig. 4 is a longitudinal cross section taken through line 4—4 of FIG. 6 of a second embodiment of the present invention.

FIG. 5 is a perpendicular cross section taken through line 5—5 of FIG. 6.

FIG. 6 is a plan outline of the second embodiment of the present invention shown in FIGS. 4 and 5.

FIG. 7 is a plan outline of a third embodiment of the present invention.

FIG. 8 is a diagrammatic plan view of a core mining bit utilizing teeth made according to the third embodiment illustrated in FIG. 7.

FIG. 9 is a diagrammatic plan view of a core mining bit employing teeth made according to the first embodiment of the invention illustrated in FIGS. 1-3.

DETAILED DESCRIPTION OF THE PREFERRED EMBODIMENTS

Figure 10:
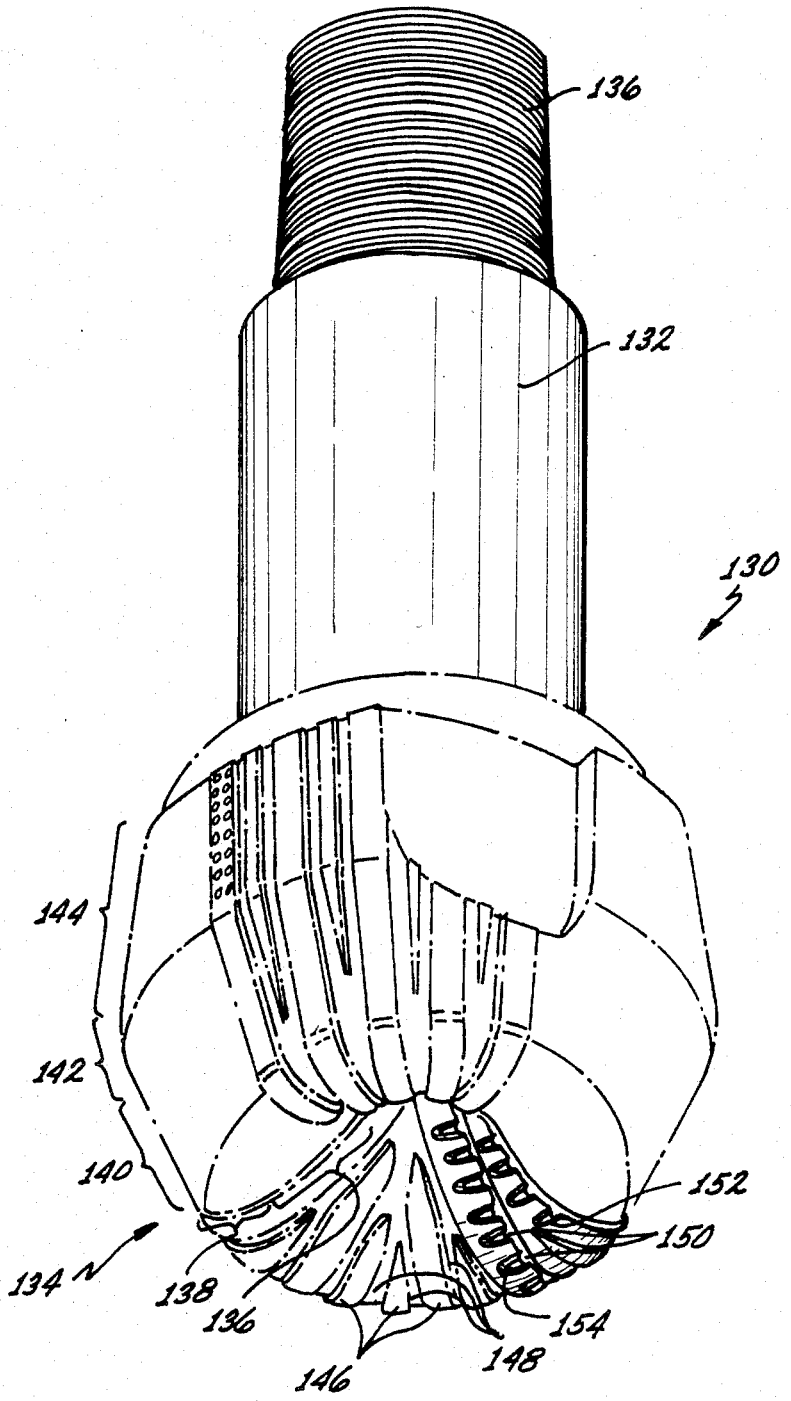
FIG. 10 is a pictorial perspective of a petroleum bit incorporating teeth of the present invention.

The present invention is an improvement in cutting teeth in diamond bits in which a polycrystalline diamond element (hereinafter PCD element) is disposed. Such elements are typically triangularly prismatic in shape with equilateral, triangular and parallel opposing faces approximately 4.0 mm on a side and a thickness between the triangular faces of approximately 2.6 millimeters. Such a PCD element is presently manufactured by General Electric Company under the trademark, GEOSET 2102. A somewhat larger diamond element is sold by General Electric Co. under the trademark GEOSET 2103 and measures 6.0 mm on a side and 3.7 mm thick. The small size of such PCD elements and the tremendous stresses to which they are subjected when utilized in a mining or petroleum drill bit makes the secure retention of these elements on the bit face extremely difficult. On the other hand, as much of the PCD element as possible should be exposed for useful cutting action.

The present invention is illustrated herein in three embodiments wherein the first embodiment, a teardrop-shaped tooth projecting from the bit face, is provided in which the PCD element is disposed. In the first embodiment, a prepad forming a generally bulbous supporting matrix in front of the leading face of the PCD element is provided in addition to a teardrop-shape and tapering trailing support. A prepad is preferred in mining bits since the high rpm at which such bits often operate set up harmonics which can otherwise loosen the PCD element. In petroleum bits where rpm is lower, the teardrop trailing support without a prepad is preferred to minimize the amount of matrix material which can interface with cutting by the diamond element. In a second and third embodiment the triangular prismatic PCD element is rotated to present an inclined side as the leading face and the PCD element is supported in a tangential set and substantially fully exposed above the bit matrix face by a teardrop trailing support. In the second embodiment, the trailing support is generally triangular while in the third embodiment the trailing support is rounded and more cylindrical. The details of the present invention and its various embodiments are better understood by considering the above described Figures in detail.

Referring now to FIG. 1, a longitudinal section through line 1—1 of FIG. 2 of the first embodiment of the invention is illustrated. Bit face 10 is the surface of the bit below which matrix material 12 extends forming the general bit body. According to the present invention, a projection, generally denoted by reference numeral 14, is provided and extends from bit face 10 to form a tooth. A PCD element 16 is disposed within projection or tooth 14. As described above, a common configuration for synthetic PCDs is an equilateral triangular prismatic shape having four millimeter sides as shown in FIG. 3 and a thickness 20 of approximately 2.6 millimeters. Clearly, the exact numeric dimensions of PCD element 16 are generally arbitrary, although they do define practical parameters with which a bit designer must work in the design of cutting teeth.

Tooth 14 is particularly characterised in the first embodiment of FIGS. 1-3 by a bulbous prepad 22, shown in FIGS. 1 and 2, having a thickness 24. Prepad 22 extends from point 26 on bit face 10 to the apical 28 of tooth 14. PCD element 16 is set in tooth 14 in a radial set such that its leading face 30 is one of the equilateral triangular faces, as shown in FIG. 3, taken through line 3—3 of FIG. 2. Leading face 30 is adjacent and contiguous to the trailing face of prepad 22 which provides leading support and cushioning for the more friable diamond material of PCD element 16. Matrix material 12 is of a conventional tungsten carbide sintered mixture and although softer than PCD element 16, is substantially more resilient and the friability of tooth 14 as a whole is limited by the friability of PCD element 16.

A trailing support 32 is provided behind and contiguous to trailing face 34 of PCD element 16. Trailing support 32 is better shown in plan outline in FIG. 2 and has a generally tear-drop shape which gradually tapers from the generally triangular cross section of trailing face 34 to a point 36 on bit face 10. Trailing support 32 has a length 38 sufficient to provide adequate back support to PCD element 16 to prevent fractures of element 16 when element 16 is subjected to the high tangential stresses encountered during the operation of rotary bit on which tooth 14 is fomed. Referring particularly to FIG. 2, a plan outline of tooth 14 is illustrated. A PCD element 16 extends from leading face 30 along entire midsection 38 of tooth 14 to trailing face 34 of element 16, which is then supported and contiguous with a substantially congruous trailing support 32 tapering down to point 36 on bit face 10.

By reason of the combination of elements set forth in the first embodiment illustrated in FIGS. 1-3, a substantial portion of the entire height 40 of PCD element 16 can be exposed above the level of bit face 10, thereby extending the useful life of tooth 14 and maximizing the utilization of cutting and wearing action of PCD element 16. In the preferred embodiment, the PCD element is positioned in the tooth, but a portion of the PCD extends below the bit face and is partly supported by the bit face in addition to key being supported by the tooth. Then, as the tooth wears, as it normally will, the PCD still remains supported in the face. Such an arrangement also allows the PCD to be disposed with sufficiently great height above the bit face than is the case with conventionally surface-set spheroidal diamond in which about $\frac{2}{3}$ of the diamond is normally located below the face.

FIGS. 4-6 illustrate a second embodiment of the present invention wherein PCD element 42, which is of the same size and shape as element 16 shown and described in connection with first embodiment FIGS. 1-3, is set in a tooth, generally denoted by reference numeral 44 in a tangential set. In other words, element 42 is rotated 90° from the orientation illustrated in FIGS. 1-3 so that the leading face of element 42 is one of the sides of the triangular shaped element. Thus, as shown in the longitudinal section of FIG. 4 taken through line 4—4 of FIG. 6, one of the equilateral triangular faces 46 is disposed substantially perpendicular to cutting direction 48 and raked backwardly so that exposed side 50 is tilted approximately 75° backward from the vertical. The backward rake of PCD element 42 is chosen to maximize the shearing action of element 42 against the rock formation according to each application for which the rotary bit is designed. The inclination illustrated in FIG. 4, however, has been chosen only for the purposes of example.

As shown in FIG. 4, a leading edge 52 of element 42 is disposed and embedded within bit face 10 since there is no prepad. As a practical matter, little cutting action will occur after the teeth of a rotating bit have worn down to bit face 10.

Element 42 is similarly supported by a teardrop-shaped trailing support 54, best shown in longitudinal section in FIG. 4 and in plan view in FIG. 6. As best shown in FIG. 6, trailing support 54 is characterised by a triangular apical ridge 56 extending from and tapering from element 42 to a point 58 on bit face 10. In addition, as best illustrated in FIG. 5, width 60 of element 42 is narrower than width 62 of tooth 44. Therefore, matrix material 12 is provided on each side of element 42 providing a measure of lateral support as well as tangential support. Therefore, as seen in FIG. 6, the leading face of tooth 44 may also include flat matrix portions 64 on each side of element 52 leading to the top of apical ridge 56. In practice, apical ridge 56 may not be sharply defined at or near the top of element 42 as illustrated in FIG. 6. Thus, ridge 56 may not assume a sharp defined outline until some distance behind the top edge 66 of element 42. In such a case, the amount of tangential support provided by tear drop shaped tooth 44 is minimized at edge 66 and increases towards bit face 10.

The third embodiment as illustrated in FIG. 7 provides additional support to a tangentially set PCD element 68. Referring to FIG. 7, PCD element 68 is set within tooth 70 in substantially the same manner as element 42 is set within tooth 44 of the second embodiment of FIGS. 4–6. However, in the third embodiment of FIG. 7, tooth 70 is provided with a rounded or generally cylindrical upper surface as shown by the curved outline of lateral matrix faces 72 on each side of the leading face of tooth 70. In addition, the degree of tapering of tooth 70 to point 74 is more gradual and rounded as shown by the plan outline of FIG. 7 thereby providing an increased amount of matrix material behind PCD element 68 as compared with the second embodiment of FIGS. 4–6.

Each of the first, second and third embodiments illustrated in FIGS. 1–7, share the common characteristic of having a teardrop-shape and tapering trailing support. This, then, minimizes the amount of tungsten carbide matrix material 12 within the tooth which must be worn away before the PCD element is exposed for useful cutting action or which must continue to be worn away as the cutting action proceeds. However, the PCD element in each case must be supported at least on its trailing surface as much as possible to prevent the tangentially applied reactive forces during drilling from dislodging the PCD element from the bit face. The teardrop-shaped and tapering booth outline as described herein provides an optimum tooth shape for maximizing the retention of the PCD element on bit face 10 and thereby extending the useful life of a rotary bit incorporating such diamond cutters.

FIG. 8 illustrates a plan diagrammatic view of a test mining core bit employing teeth of the third embodiment of FIG. 7. Similarly, FIG. 9 is a simplified diagrammatic plan view of a test mining core bit employing the teeth of the first embodiment of FIGS. 1–3. In each case, a test mining core bit has been used only for the purposes of example and it must be understood that the same tooth design can be used on conventional and more complex tooth configuration patterns well known in the art without departing from the spirit and the scope of the present invention. The examples of FIGS. 8 and 9 have been shown only for the purposes of completeness of description to illustrate how the teeth of the present invention can be used in a rotary bit. The illustrated embodiment should not thus be taken as a limitation to a specific type of bit or tooth pattern.

Turning now to FIG. 8, a rotary bit, generally denoted by reference numeral 76, is shown in the form of a mining core bit having an outer gage 78 and inner gage 80. Such inner and outer gages 78 and 80 may also include PCD elements flushly set therein in a conventional manner to maintain the gage diameters. Face 82 of bit 76 is thus divided into four symmetric sectors of 90° each. Each sector includes eight teeth of the type and description shown in connection with FIG. 7. The leading and radially outermost tooth 84 is radially disposed on face 82 so that the PCD element therein is just set in bore outer gage 78 to define and cut the outer gage of the hole. Similarly, the innermost leading tooth 86 is disposed on bit face 82 opposite that of tooth 84 in a similar manner such that a PCD element 86 defines and cuts the inner gage of the hole. The remaining intermediate teeth 88–94 are sequentially set at increasing angular displacements behind leading tooth 84 and at radial steps toward center 96 of bit 76 to form a series of radially offset cutting elements to sweep the entire width of bit face 82 between outer gage 78 and inner gage 80. The sequential series of teeth 88–94 is followed by a redundant innermost tooth 96 which is radially set in the same manner as leading innermost tooth 86. Similarly, a radially trailing outermost tooth 98 is radially set in the same manner as leading tooth 84 to provide a redundant cutting element for the outer gage 78. Typically, tooth loss or failure occurs most often on the gages and particularly the outer gage so that redundancy of the tooth pattern is designed to occur on the gages so that the cutting action can continue even if one or more of the gage teeth are lost.

The sector illustrated and described above is repeated four times around bit face 82 thereby resulting in further redundancy. As shown in the plan view in FIG. 8, each of the teeth, 84, 88–96 may include overlapping elements where the position of the teeth on bit face 82 is such that the teeth crowd more closely than their plan outline would otherwise freely permit. In such a case, an integral overlap is established such as is diagrammatically suggested in FIG. 8. Each of the teeth as described above are integral with the underlying matrix and similarly, are integral with any overlapping matrix forming an adjacent tooth. The cutting action of one element is not affected by the overlapping matrix material. Corresponding to the tooth of an adjacent cutting element, because such overlapping material is configured to generally be disposed at a lower height than matrix material of the tooth which is overlapped. Further, none of the necessary trailing support for any of the cutting elements is deleted by virtue of the overlap as shown in FIG. 8 and only such additional matrix material is added behind a cutting element necessary to support an adjacent cutting element. Therefore, the interference by the matrix action with exposure of the cutting elements is minimized without any loss in the maximal support provided to each cutting element to the tooth shape.

Referring now to FIG. 9, another tooth configuration is illustrated using the first embodiment of FIGS. 1–3, also illustrated in a mining core bit. Again, the improvements in the tooth shape are not limited to the tooth pattern and bit application described herein and such teeth can be used in more complex mining, coring and petroleum bits well known to the art without significant modification. Again, bit 100 is characterised by an outer gage 102 and an inner gage 104, including flushly disposed gage cutter (not shown). Bit face 106 is divided into three indentical and symmetrical segments separated by waterways 108 wherein each segment includes at least six teeth of the type described in connection with FIGS. 1–3. A radially innermost first, leading tooth 110 which includes a radially set PCD element is followed in sequence by a series of teeth disposed on bit face 106 at increasing radial positions and angular displacements behind leading tooth 110. Specifically, teeth 110–116 span the width 118 of bit face 106 ending in an outermost radially disposed tooth 116. Fewer teeth are required in the embodiment of FIG. 9 as compared to FIG. 8 inasmuch as the triangular prismatic PCD element is radially set in FIG. 9 and has a width of 4 millimeters as compared to a leading width of 2.6 millimeters when tangentially set as appearing in FIG. 8.

Innermost leading tooth 110 corresponds and is matched to an outermost leading tooth 120 which, in combination with trailing tooth 116, redundantly serves to define and cut outer gage 102 of bit 100. Similarly, trailing outer tooth 116 is disposed offset by and oppositely from a trailing innermost tooth 122 which redundantly and in combination with innermost leading tooth 110 defines and cut inner gage 104 of bit 100. This same pattern is replicated about the circumference of bit face 106 three times to further increase the cutting redundancy.

Many modifications and alterations may be made those having ordinary skill in the art without departing from the spirit and scope of the present invention. For example, FIG. 9 has shown a pattern wherein a series of teeth have been employed in a nonoverlapping relationship beginning from inner gage 104 to outer gage 102. On the other hand, the bit of FIG. 8 shows a plurality of teeth in an overlapping relationship in an inwardly directed spiral beginning with outer gage 78 and finishing with inner gage 80. Thus, the cutting action of the bit of FIG. 8 will tend to have an inwardly directed component. The chips will tend to move inwardly towards the center of bit 76, while the tooth pattern of FIG. 9 has a radially outward directed component and will tend to move the cut chips outwardly to outer gage 102. In both cases, the bit face of the drill bit is substantially covered by overlapping or nearly overlapping PCD cutting elements which sweep or substantially sweep the entire width of the bit face. The teeth employed in FIG. 8 could be patterned to be outwardly spiralling as shown in FIG. 9 or vice versa without departing from the scope of the present invention.

Although the PCD element has been illustrated and described as a triangular prismatic shape, other shaped diamond elements could also be adapted to teeth of the present design. For example, cylindrical, or cubic elements are also included within the range of the present invention.

FIG. 10 is a pictorial view of a petroleum bit incorporating teeth improved according to the present invention. Petroleum bit 130, as in the case of mining bits 76 and 100 illustrated in connection with FIGS. 8 and 9, includes a steel shank 132 and conventional threading 136 defined on the end of shank 132 for coupling with a drill string. Bit 130 includes at its opposing end a bit face, generally denoted by reference numeral 134. Bit face 134 is characterised by an apex portion generally denoted by reference numeral 136, a nose portion generally denoted by a reference numeral 138, a flank portion 140, a shoulder portion generally denoted by reference numeral 142, and a gage portion generally denoted by reference numeral 144. Bit face 134 includes a plurality of pads 146 disposed in a generally radial pattern across apex 136, nose 138, flank 140 and shoulder 142 and gage 144. Pads 146 are separated by a corresponding plurality of channels 148 which define the waterways and collectors of bit face 134. Hydraulic fluid or drilling mud is provided to the waterways of bit face 134 from a central conduit (not shown) defined in a conventional manner within the longitudinal axis and body of bit 130.

As illustrated in pictorial view in FIG. 10, each pad 146 includes a plurality of teeth 150 defined thereon such that the longitudinal axis of the tooth lies along the width of the pad and is oriented in a generally azimuthal direction as defined by the rotation of bit 130. PCD elements 152 included within tooth 150 are followed by and supported by a trailing support 154 of the type shown and described in connection with FIG. 7. PCD element 152 and trailing support 154 as described above constituting a singular geometric body comprising the tooth 150. As illustrated in the FIG. 10, PCD elements 150 are disposed near the leading edge of each pad 146. Thus, bit 130 as shown in FIG. 10 is designed to cut when rotated in the clockwise direction as illustrated in FIG. 10.

The particular design of petroleum bit 130 as shown in FIG. 10 has been arbitrarily chosen as an example and a tooth design improved according to the present invention can be adapted to any pattern or type of petroeum, coring or any other type of drilling bit according to the teachings of the present invention.

Therefore, the presently illustrated invention has been described only for the purposes of example and should not be read as a limitation or restriction of the invention as set forth by the following claims.

We claim:

1. A rotatable bit for use in earth boring comprising a carbide metal matrix body member having portions forming a gage and a cutting surface, said cutting surface including a plurality of channels forming pad means between the adjacent channels, each said pad including a plurality of spaced synthetic polycrystalline diamond cutting elements mounted directly in the matrix during matrix formation, each of said cutting elements being of a predetermined geometrical shape and being temperature stable to at least about 1200° C., the said cutting elements including a portion received within the matrix body of said pad and an exposed portion which extends above the surface of said pad and forming the cutting face and said cutting element, the cutting element including at least one surface spaced from said cutting face, matrix material extending above said pad and contacting at least a portion of said one surface spaced from said cutting face to form a matrix backing to support said cutting element, and the exposed portion of each of said elements extending above the surface of said pad a distance greater than the amount of said cutting element which is received within the body matrix of said pad.

2. A rotatable bit as set forth in claim 1, wherein said cutting element is a porous synthetic polycrystalline diamond.

3. A rotatable bit as set forth in claim 1 wherein said bit is a core bit.

4. A rotatable bit as set forth in claim 1 wherin at least some of said cutting elements are positioned at the junction of the pad and the channel.

5. A rotatable bit as set forth in claim 1 wherein said cutting element includes front, side and rear surfaces, and said matrix material which extends above said pad being in engagement with said side and rear surfaces of said cutting element.

6. A rotatable bit for use in earth boring comprising:

a carbide metal matrix body member having portions forming a gage and a cutting surface, said cutting surface including a plurality of channels forming a pad means between adjacent channels, each said pad including a plurality of spaced synthetic polycrystalline cutting elements mounted directly in the matrix during matrix formation, each of said cutting elements being of a predetermined geometrical shape and having front, side and rear faces and being temperature stable to at least about 1200° C., the said cutting elements including a portion received within the matrix body of said pad and an exposed portion which extends above the surface of said pad, matrix material extending above said pad and contacting said side and rear faces whereby said exposed front face forms the cutting surface of said cutting element, matrix material contacting the rear face of said cutting element being greater in length than the width of matrix material contacting the side of said cutting elements, and the exposed front face of said cutting element extending above the surface of said pad a distance greater than the amount of said cutting element which is received within the body matrix of said pad.

7. A rotatable bit for use in earth boring comprising a metal matrix body member having portions forming a gage and a cutting surface, a plurality of spaced synthetic polycrystalline diamond cutting elements mounted directly in the matrix of said cutting surface during matrix formation of said body member, each of said synthetic polycrystalline diamond cutting elements being of a predetermined geometrical shape and having a front cutting face and a rear portion and being temperature stable to at least about 1200° C., the said elements including a portion received within said matrix body and an exposed portion which extends above the surface of said matrix, matrix material extending above said body and contacting said rear portion whereby said exposed front cutting face forms the cutting surface of said cutting element, the matrix material contacting the rear portion of said cutting element extending to the top of the exposed portion of said cutting element, the exposed portion of said cutting element extending above the surface of said matrix body a distance greater than the amount of said cutting element which is received within the metal matrix body member.

8. A rotatable bit for use in earth boring comprising:

a metal matrix body member having portions forming a gage and a bit face, a plurality of spaced synthetic polycrystalline diamond cutting elements mounted directly in the matrix of said bit during matrix formation of said body member, each of said synthetic polycrystalline diamond cutting elements being of a predetermined geometrical shape and having a front cutting face and being temperature stable to at least about 1200° C., the said elements being supported by matrix material on all surfaces other than said front cutting face, said cutting face of said cutting element extending above said bit face and forming an exposed front cutting face which forms the cutting surface of said cutting element, and the matrix material contacting the rear portion of said cutting element extending to the top of the exposed portion of said cutting element, the exposed front face of said cutting element having more exposed cutting surface above said bit face than the amount of said cutting element which is received within said matrix body member.

9. A rotatable bit for use in earth boring comprising:

a matrix body member having portions forming a gage and a face, said face including a plurality of waterways forming pad means between adjacent waterways, each said pad means including a plurality of spaced synthetic polycrystalline diamond cutting elements mounted directly in the matrix during matrix formation, each of said cutting elements being of a predetermined geometric shape and being temperature stable to at least about 1200° C., the said cutting elements including a portion received within the matrix body member of said pad means and a portion which extends above the surface of said pad means and which is adapted to form the cutting face of said cutting element, each cutting element including side faces and a rear face spaced from said cutting face, matrix material extending above said pad means and forming a plurality of spaced teeth, at least some of said cutting elements being positioned in said teeth, at least some of said teeth including a trailing support contacting the rear face of the associated cutting element, the portion of at least some of the cutting elements which extend above the matrix of said body member and which forms the cutting face being fully exposed and being essentially free of matrix material, the side faces of each of the cutting elements received in said teeth extending above said pad, and the portion of each of said cutting elements which forms the cutting face of said cutting elements extending above the surface of the corresponding pad a distance greater than the amount of said cutting element which is received within the body matrix of said pad.

10. A rotatable bit as set forth in claim 9, wherein said cutting element is a porous synthetic polycrystalline diamond.

11. A rotatable bit as set forth in claim 9, wherein said bit is a core bit.

12. A rotatable bit as set forth in claim 9, wherein at least some of said cutting elements are positioned such that the front face of some of said cutting elements is at the junction of said pad and waterway.

13. A rotatable bit as set forth in claim 9, wherein said matrix of said tooth is at least in partial engagement with the side faces of at least some of said cutting elements.

14. A rotatable bit as set forth in claim 9, wherein said matrix of said tooth fully engages and fully covers the side faces of at least some of said cutting elements.

15. A rotatable bit for use in earth boring comprising:

a carbide matrix body member having portions forming a gage and a face, said face including a plurality of waterways forming pad means between adjacent waterways, each said pad including a plurality of spaced synthetic polycrystalline diamond cutting elements mounted directly in the matrix during matrix formation, each of said cutting elements being of a predetermined geometric shape and being temperature stable to at least about 1200° C., the said cutting elements including a portion received within the body matrix of said pad and a front portion and side faces which extend above the surface of said pad, said front portion forming the cutting face of said cutting element, matrix material extending above said pad and forming a plurality of spaced teeth each of which includes a trailing support generally to the rear of the side faces and the front portion of said cutting element, the side faces of at least some of said cutting elements being at least partially covered by a portion of the matrix material which forms said associated tooth, the front portion of said cutting elements forming the cutting face thereof, said trailing support for at least some of said teeth being tapered to the rear of the cutting face, said front portion of said cutting elements which extends above said pad and which forms the cutting face thereof being fully exposed and free of matrix material, and the portion of each of said elements which forms the cutting face extending above the surface of the corresponding pad a distance greater than the amount of said cutting element which is received within the body matrix of said pad.

16. A rotatable bit for use in earth boring comprising:

a matrix body member having portions forming a gage and a face, a plurality of spaced synthetic polycrystalline diamond cutting elements mounted in the matrix of said face of said body matrix, said bit including a plurality of waterways, each of said cutting elements being of a predetermined geometric shape and being temperature stable to at least about 1200° C., each of said cutting elements having a front cutting face, side faces and a rear portion, all of which extend above said body matrix, and each of said cutting elements including a portion received within said body matrix, at least some of said cutting elements on said face being mounted in a tooth, a plurality of which are on said face and formed of matrix material to receive at least some of said cutting elements, at least some of said teeth including a trailing support contacting the rear portion of said cutting elements and side portions which engage at least a portion of the side faces of said cutting elements, and the front and side surfaces and said rear portion of said cutting elements extending above the face of said matrix a distance greater than the amount of said cutting element which is received within said body matrix.

17. A rotatable bit for use in earth boring comprising:

a matrix body member having portions forming a gage and a bit face, a plurality of spaced synthetic polycrystalline diamond cutting elements mounted directly in said matrix of said bit during matrix formation of said body member, each of said cutting elements being of a predetermined geometric shape and having a front face adapted to form the cutting front face and side and rear faces, and being temperature stable to at least about 1200° C., the said cutting elements being supported by a tooth, a plurality of which are provided on said bit face to support a plurality of cutting elements, said front, side and rear faces of said cutting elements extending above the matrix of the bit face in which they are mounted, each tooth including a body of matrix material which covers at least a portion of the side faces and all of the rear face while all of the front face above the body member is fully exposed, and at least the front face of said cutting element which is adapted to form said cutting face extending above the matrix of the bit face in which they are mounted a distance greater than the amount of said cutting element which is received within the matrix of said bit face.

18. A rotatable bit as set forth in any of claims 9 to 17, wherein said cutting element is triangular in shape and includes a front face, adjacent side faces, a base face and a rear face, and at least a portion of said base face being received in said body matrix and said front face being adapted to form the cutting face of said cutting element.

19. A rotatable bit as set forth in claim 9, wherein said cutting element is triangular in shape and includes front, side, rear and base faces, and wherein said side faces form an apex which constitutes a top surface of said cutting element.

20. A rotatable bit as set forth in claim 19, wherein each said apex is oriented radially with respect to said tooth.

21. A rotatable bit as set forth in claim 19 wherein said apex is oriented tangentially with respect to said tooth.

22. A rotatable bit as set forth in claim 19, wherein at least some of said cutting elements are spaced from the intersection of said waterway and said pad means.

* * * * *